United States Patent [19]

Meier

[11] 4,364,297

[45] Dec. 21, 1982

[54] KEYBOARD SPRING RETURN MECHANISM

[75] Inventor: James Meier, Des Plaines, Ill.

[73] Assignee: Norlin Industries, Inc., White Plains, N.Y.

[21] Appl. No.: 133,562

[22] Filed: Mar. 24, 1980

[51] Int. Cl.[3] ..... G10C 3/12

[52] U.S. Cl. ..... 84/440; 84/433

[58] Field of Search ..... 84/432, 433, 434, 435, 84/436, 439, 440, 1.01, 423

[56] References Cited

U.S. PATENT DOCUMENTS

| | | | |
|---|---|---|---|
| 2,913,949 | 11/1959 | Lidblom | 84/440 |
| 3,026,760 | 3/1962 | Fauser | 84/423 |
| 3,175,451 | 3/1965 | Klann | 84/433 |
| 3,306,152 | 2/1967 | Klann | 84/423 |
| 3,330,176 | 7/1967 | Schwartz et al. | 84/433 |
| 3,413,885 | 12/1968 | van der Lely | 84/435 |
| 3,447,414 | 6/1969 | Lo Duca | 84/436 |
| 3,657,459 | 4/1972 | Peterson | 84/8.01 |
| 3,935,784 | 2/1976 | Koepke | 84/435 |
| 4,068,552 | 1/1978 | Allen | 84/433 |
| 4,128,035 | 12/1978 | Erickson et al. | 84/433 |

*Primary Examiner*—L. T. Hix
*Assistant Examiner*—Alan Mathews
*Attorney, Agent, or Firm*—Ronald J. Kransdorf

[57] ABSTRACT

A keyboard mechanism for musical instruments which includes a key return spring made from resilient wire bent to form a pair of flexure spring arms connected by a bight. The arms have elbow bends. The ends of the arms have wrist bends, and are trapped in apertures formed in the frame of the instrument. The bight is trapped in one of a plurality of notches on the outer surface of the key. The spring is located close to the fulcrum of the key, in order to reduce the moment arm and spring deflection, both of which contribute to undesirable force build-up.

14 Claims, 5 Drawing Figures

KEYBOARD SPRING RETURN MECHANISM

This invention relates generally to musical keyboards, particularly piano-style keyboards for electronic musical instruments.

BACKGROUND AND PRIOR ART

Piano-style keyboards employed in electronic musical instruments have operating environments different from those of acoustical instruments. Conventional piano keys are designed to deliver hammer blows, while conventional organ and accordion keys are designed to open air valves. In contrast, the keys of electronic organs, synthesizers, etc. are designed simply to operate electrical switches which impose little or no mechanical load on the key action. Therefore electronic musical instrument keys typically require return spring mechanisms strong enough to provide some tactile sensation of resistance when the keys are depressed, as well as to return the keys to their original positions after they are released.

In the past, such return spring mechanisms have suffered from excessive "build-up"; i.e. the force exerted by the return spring in opposition to the musician's fingers increases significantly as the key gets further into its downstroke. It has not been unusual for some prior art key return spring mechanisms to exert twice as large an opposing force at the end of the key stroke as they do at the beginning. This degree of force build-up makes it more difficult to play the instrument.

One way to reduce force build-up is to locate the spring biasing point closer to the fulcrum of the key, thus reducing the moment arm over which the spring acts, and also reducing the amount of spring deflection. Since the torque exerted on the key is proportional to both the moment arm and the spring deflection, both factors affect the force build-up.

In the past some return spring mechanisms, such as the one shown in U.S. Pat. No. 4,128,035, have employed coil springs located at the rear of the key, far from the fulcrum. Such coil springs can be relocated closer to the fulcrum, but that tends to make them inaccessible. However, coil springs are quite inexpensive, and it is desirable that any alternative mechanism remain competitive in cost.

Locating the return spring at the rear of the key can be disadvantageous in some other respects. Recently there have been certain advances in the design of key switches. These advances can best be realized by locating each such switch at the rear of the key which actuates it. The best way to make room at the rear of the key for the installation of such a switch mechanism is by removing the return spring from its rear location, and relocating it to some other part of the key.

Another problem with prior art key return spring mechanisms is that they are often difficult to assemble, or to reassemble when replacement of the return spring proves necessary. In particular, prior art mechanisms usually locate the return spring somewhere below and behind the keyboard, which makes access difficult. It also obscures the fact that a spring has broken or become dislodged from its operating position.

BRIEF SUMMARY OF THE INVENTION

The return spring of this invention is used in conjunction with a key which is supported at a pivot location by fulcrum means. In the broadest form of the invention the return spring has at least one flexure spring arm bent to form an elbow. Anchoring means on the frame of the instrument engage an inner end of the spring arm at an anchoring location. Trapping means on the key engage an outer end of the spring arm at a biasing location between the pivot location and one end of the key, thus bringing the spring much closer to the fulcrum. In addition the spring arm is flexurally stressed to exert a return force on the key. This flexure spring is competitive in cost with a coil spring, but is more easily accommodated than a coil spring would be at the new location near the fulcrum. The new location has the advantages of a shorter moment arm and smaller spring deflection, causing the force build-up to be greatly reduced. The new location also leaves room at the rear of the key for installation of an advanced form of key switch.

In a more specific form of the invention the return spring has two of the bent spring arms described above. Using the term "outer" to refer to the direction in which the finger-striking surface of the key faces (e.g. upwardly in the case of an organ keyboard), then the "outer" portions of these spring arms are joined by a bight to form a U-shaped return spring. The spring straddles the key with the bight engaging means on the outer surface of the key, in which the bight is trapped. This has the distinct advantage of making the return spring both visible and accessible from outside the keyboard assembly. As a result, initial assembly of the keyboard is facilitated, and it is also easier to diagnose and replace a spring that is broken or dislodged.

On a more specific level, there are a plurality of alternative spring-tapping notches at different locations on the outer surface of the key. This affords a choice of different levels of spring return force, depending on whether a notch is chosen which is closer to or further away from the anchoring location.

Another feature of the invention involves forming the fulcrum means as an upstanding member and the anchoring means as an aperture in the fulcrum means. This aperture then receives the inner end of the spring arm. This feature further facilitates assembly or replacement of the return spring mechanism, since it is only necessary to insert the inner ends of the spring arm into the anchoring aperture and engage the outer end with the trapping means which is visible atop the key. In the most specific form of the invention, this simply involves deforming the spring until the bight snaps into the chosen notch. Nor are any special tools required for this operation.

DETAILED DESCRIPTION OF THE PREFERRED EMBODIMENT

The present invention is an improvement in the type of keyboard disclosed in the above mentioned U.S. patent, which is hereby incorporated by reference. The keyboard to be described herein is identical to that of the earlier patent in all respects except as to the novel return spring mechanism of this invention. Therefore, as to certain non-essential background details of keyboard construction, it will be sufficient simply to refer to the earlier patent.

Figure 1:
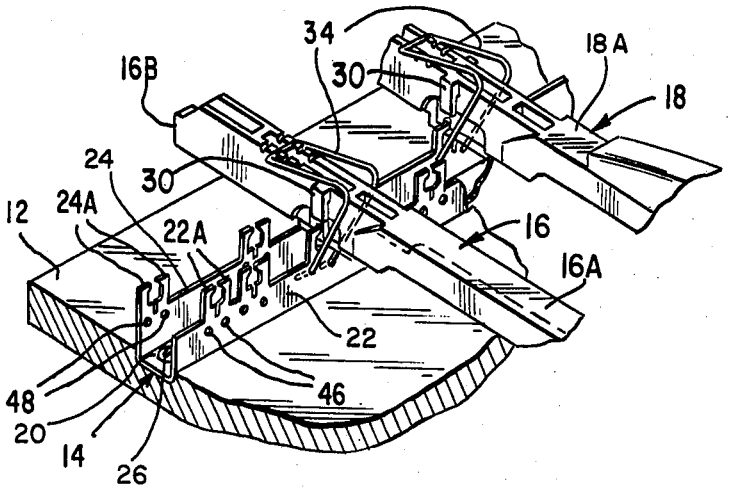
FIG. 1 is a perspective view of a portion of an electronic organ or synthesizer keyboard including one white (natural) key mechanism and one black (sharp/-flat) key mechanism, both of which incorporate this invention.

The keyboard seen in FIG. 1 is mounted upon a frame member 12. A channel member 14 serves as a fulcrum for pivotally mounting a plurality of keys in a piano-style keyboard. Only two of these keys (a white key 16 for sounding a natural note, and a black key 18 for sounding a sharp or flat note) are shown, the others being omitted for clarity of illustration. The white keys are somewhat longer than the black keys, as is conventional.

The channel member 14 is U-shaped, and includes a base 20 and front and rear upstanding walls 22 and 24. The base 20 is secured to the frame member 12 by fasteners 26. The front wall 22 is formed with pairs of upstanding tabs 22A, B, C etc., which serve as fulcrums about which respective white keys (e.g.—key 16) pivot back and forth when the keyboard is used. Similarly the back wall 24 is formed with pairs of fulcrum tabs 24A, B. C etc. which serve the same purpose for the black keys (e.g. key 18). Each fulcrum tab fits upwardly into a groove formed between pairs of lands 28 (FIG. 3) formed on both sides of each key 16 and 18. Panels 30 overlap the fulcrum tabs on each side of each key to restrain the keys against lateral movement relative to the fulcrum tabs. Each key pivots between a depressed limit position and a released limit position, both of which may be established by any one of the means which are conventional in the keyboard art.

Figure 2:
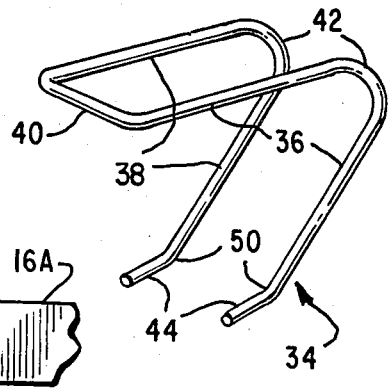
FIG. 2 is a perspective view of a key return spring in accordance with this invention.

Each key is biased toward its released limit position by a return spring 34. As best seen in FIG. 2, this spring is formed from resilient metal wire, and has an overall U-shaped configuration comprising two arms 36 and 38 connected by a bight segment 40. These arms are bent to form respective elbows 42. It will be appreciated from the description which follows that the arms 36 and 38 function as two separate springs which flex at their respective elbow bends 42. The ends of the arms remote from the bight 40 are designated 44, and may be referred to as anchored ends because they are anchored to the frame of the instrument. The ends of the arms which join the bight 40 may be thought of as biasing ends, because the bight exerts the biasing force upon the key 16 or 18.

The geometrical relationship of the return springs 34 to their keys 16 and 18 may best be appreciated from a description of how the springs are assembled therewith. The upstanding front wall 22 is formed with a pair of apertures 46 below each pair of fulcrum tabs 22A, B, C etc. These apertures serve to anchor the ends 44 of the return springs 34 of the white (natural note) keys 16 at a location inwardly of (i.e. below) the keys. Similarly, the upstanding rear wall 24 is formed with a pair of apertures 48 below each pair of fulcrum tabs 24A, B, C etc. which serve to anchor the ends 44 of the return springs 34 of black (sharp and flat) keys 18 at a location inwardly of the keys.

Figure 3:
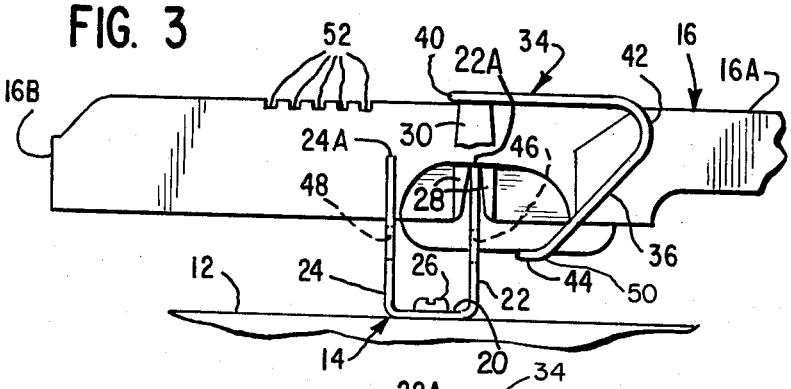
FIG. 3 is a side elevational view of a portion of one of the key mechanisms of FIG. 1, with the return spring thereof in position to be assembled therewith.

During initial assembly (or subsequent replacement), the spring 34 is first placed in the position seen in FIG. 3. The bight 40 is then resting on the outer surface 16A of key 16, i.e. the surface which faces outwardly of the instrument for access by the fingers of the musician. (In the case of the keys 18, the spring 34 would be placed on the outer surface 18A thereof). The arms 36 and 38 extend inwardly (i.e. below the key) at either side of the key, so that the U-shaped spring 34 is straddling the key 16 or 18.

Note that the anchoring ends 44 of the spring arms 44 are bent at "wrists" 50 so that they are more or less parallel to those portions of arms 36 and 38 which are between the elbow bends 42 and the bight 40. Consequently, when the spring 34 is held in the position illustrated in FIG. 3, the anchoring ends 44 are pointing more or less straight at the upstanding walls 22 and 24. Moreover, the anchoring apertures 46 (or in the case of black key 18, the anchoring apertures 48) are located directly in line with those ends 44.

Lateral misalignment of the spring ends 44 with respect to the apertures 46 and 48 is prevented by having the spring arms 36 and 38 straddle the keys 16 and 18 closely enough so that the springs 34 cannot be displaced far enough to either side of the keys to cause the spring ends 44 to miss the apertures. If a given spring 34 is moved to the right, with respect to the viewing direction of FIG. 1, its left arm 36 will strike the left side of key 16 or 18 before the spring ends 44 can move too far to the right to enter the apertures 46 or 48. Or if the spring is moved to the left, its right arm 38 will strike the right side of the key 16 or 18, again to prevent lateral misalignment of the spring ends 44 relative to the apertures 46 or 48.

From the position of FIG. 3, the spring 34 is moved rearwardly, i.e. toward the walls 22 and 24, which causes the spring ends 44 to enter the appropriate anchoring apertures, even though these apertures cannot be seen from outside the keyboard. Thus, installation can be done "blindly". As the spring penetrates the anchoring apertures 46 or 48, those portions of arms 36 and 38 which are slightly above the wrists 50 eventually engage the outer (or upper) edges of the anchoring apertures (e.g. at location 46A in FIG. 4). The spring ends 44 thus become anchored within the apertures 46 and 48, because they cannot move any further rearwardly.

Figure 4:
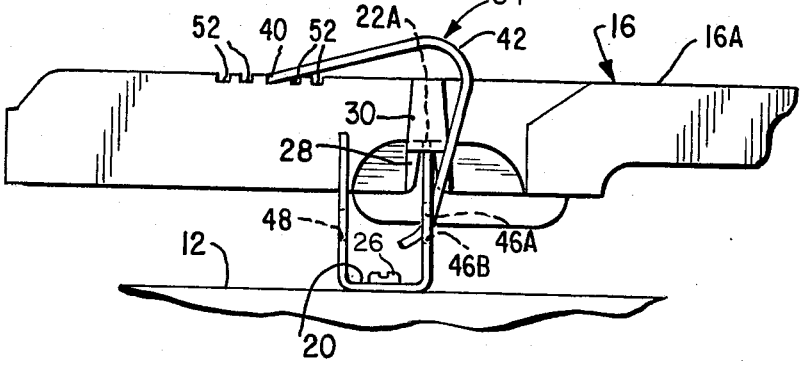
FIG. 4 is a side elevational view of the same portion of the same key mechanism as in FIG. 3, but with the return spring fully assembled therewith.
Figure 5:
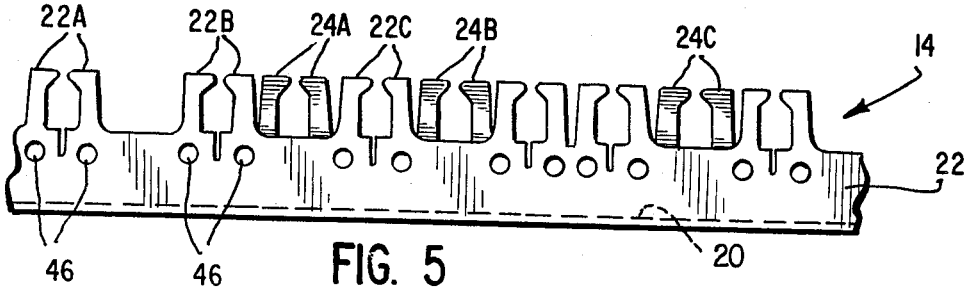
FIG. 5 is a front elevational view of the fulcrum channel member of the keyboard of FIG. 1.

The bight 40 is then moved further rearwardly across the outer surface of the key 16A (or 18A), thus causing the entire spring 34 to rotate counter-clockwise about the upper edges of apertures 46 (or 48), i.e. from the position of FIG. 3 to the position of FIG. 4. As this rotation proceeds, the elbow bends 42 rise upwardly to outwardly from the plane of the outer key surface 16A (or 18A, as the case may be) to the position seen in FIG. 4.

As the bight 40 continues to be pushed rearwardly across the outer key surface 16A (or 18A), eventually the distance between the bight 40 and the now anchored spring ends 44 increases. This causes the flexure spring arms 36 and 38 to be stressed, or pre-loaded, by forcing the angle of the elbow bends 42 to open up beyond their rest position. As a result, the anchoring ends 44 of the two flexure spring arms 36 and 38 react against their respective anchoring apertures 46 and 48, and the biasing end (i.e. bight 40) of the flexure spring arms exerts an inward (or downward) biasing force upon the outer surface 16A (or 18A) of the key 16 (or 18).

The rearward displacement of the bight 40 by now has moved the bight to the rear of the fulcrum tabs 22A, B, C etc. or 24A, B, C etc.; e.g. to a biasing location between the fulcrum tabs and the rear end (for example 16B) of the key. As a result, the biasing force exerted by the bight 40 causes a torque tending to rotate the key 16 (or 18) counter-clockwise about the fulcrum tabs 22A, B, C etc. (or 24A, B, C etc.) with respect to the viewing direction in FIGS. 1, 3 and 4. This is the proper direction to keep the key 16 (or 18) in its rest position and to return it to that position after actuation by the musician.

The biasing location where the bight 40 exerts its biasing force is much nearer to the fulcrum tabs 22A, B, C etc. or 24A, B, C etc. than to the rear end of the key (e.g. rear end 16B), which was the return spring biasing location in many prior art key mechanisms (see for example the patent cited above). Therefore, the moment arm (i.e. the distance between bight 40 and fulcrum tabs such as 22A and 24A, measured in a direction parallel to the longitudinal axis of the key 16 or 18) is much shorter than in prior art mechanisms having the return spring located at the rear end of the key. As a result, the additional increment of spring deflection (i.e. the further opening of the angle at elbows 42), which takes place when the key is depressed by the musician, is also reduced as compared to prior art designs. Both the reduction in moment arm and the reduction in deflection produce a reduction in the biasing force build-up sensed by the musician as he depresses the keys 16 or 18.

The bight 40 serves as a trapping segment which is trapped at the biasing location. In order to accomplish this, one or more notches 52 are provided, each one extending transversely across the entire outer surface 16A and 18A of the key 16 or 18, parallel to the bight 40. On the white keys 16 the notches 52 are all located somewhat to the rear of the fulcrum tabs 22A, B, C etc., while on the black keys 18 they are located somewhat to the rear of the fulcrum tabs 24A, B, C etc. Thus in each case a biasing location is defined between the fulcrum (or pivot location) and the rear end of the key. During installation or replacement of the spring 34, as the bight 40 is moved rearwardly across the outer key surface 16A or 18A, the pre-load spring force causes the bight to snap down, or inwardly, into one of the notches 52, and to become trapped therein. Then the spring 34, with its anchoring ends 44 anchored in the apertures 46 or 48 and its biasing end 40 trapped in one of the notches 52, is secured in assembled relation with its key 16 or 18. Since the anchored ends 44 are on the inward side of the key 16 or 18, and the biasing end or bight 40 is on the outward side 16A or 18A thereof, the pre-load spring force inherently retains the spring 34 in assembled relation with the key, and also helps to retain the key in assembled relation with the fulcrum channel 14.

The various notches 52 of each key 16 or 18 are spaced longitudinally along the key, i.e. at different moment arm distances from the pivot location (fulcrum tabs 22, B, C etc. or 24A, B. C etc.). Thus the spring return force can be adjusted by choosing to trap the spring bight 40 in a notch 52 which is either further away from or closer to the fulcrum tabs. The choice of a notch which is closer to the fulcrum results in a shorter lever arm and a smaller spring deflection (a smaller angle opening of elbow bends 42), both of which cause a smaller torque to be exerted on the key. The choice of a notch which is more remote from the fulcrum has the opposite effect. But even the most rearward of the notches 52 is still located between the fulcrum and the rear end of the key, in contrast to the biasing location of many prior art key mechanisms.

Ease of installation of the spring 34 is greatly facilitated by several features of the invention. The insertion of the spring ends 44 blindly into the anchoring apertures 46 and 48 was described above. In addition, the notches 52 and bights 40 are visible because of their location on the outward side of the keys 16 and 18, so that it is not difficult to seat the bight within a selected notch. Moreover, if the spring 34 should break or become dislodged, that fact is readily detectable by visual inspection of the bight 40, at which time insertion of a replacement spring is as easy as the initial assembly. This stands in sharp contrast to earlier mechanisms in which the return spring was in a location inward and rearward of the keys, where it was difficult to see or reach. Finally, no tools are needed to assemble or reassemble this return spring mechanism, since it is only necessary to push the spring 34 rearwardly by hand to engage the ends 44 with the anchoring apertures 46 and 48 and to engage the bight 40 with the chosen notch 52.

The described embodiment represents the preferred form of the invention and the best mode currently known. Nevertheless alternative embodiments may be imagined which would come within the novel teachings of this invention. Accordingly, the illustrated embodiments are to be considered as merely illustrative, and not as limiting the scope of the invention.

What is claimed is:

1. A keyboard mechanism comprising: a plurality of elongated keys each having opposite ends; a frame; fulcrum means on said frame mounting each said key at a pivot location intermediate the ends of said key for pivotal motion about a transverse axis; a separate return spring means for each key, each spring means having an anchored end and a biasing end and having at least one flexure spring arm bent to form an elbow at a location intermediate said ends, said elbow normally having a predetermined angle; anchoring means on said frame restraining an anchored end of each said spring means at an anchoring location intermediate the ends of the corresponding key; trapping means on each said key engaging the biasing end of the corresponding spring means at a biasing location intermediate the ends of said key; said biasing location and said pivot location being offset from each other longitudinally of said key; and each said spring means being stressed between said anchoring location and said biasing location, forcing said elbow to form an angle greater than said predetermined angle, when the corresponding key is pivoted in one direction about said fulcrum means, so as to exert a biasing torque upon said key tending to return it to its initial position.

2. A keyboard mechanism as in claim 1 wherein said anchoring location and said biasing location are spaced apart a distance to force said elbow to assume an angle greater than that which it assumes in its rest condition.

3. A keyboard mechanism as in claim 2 further comprising a plurality of alternative trapping means on each key adapted to engage said biasing end of the corresponding spring means at respective alternative biasing locations each located at a different distance from said anchoring location whereby to offer a choice of elbow angles for selecting the biasing torque exerted by said spring means on said key.

4. A keyboard mechanism as in claim 3 wherein said trapping means comprises a plurality of transverse notches formed at longitudinally spaced locations on an outward surface of said key, said biasing end of said spring means being formed with a trapping segment bent at an angle to said flexure spring arm and received in one of said notches.

5. A keyboard mechanism as in claim 4 wherein said anchoring means comprises at least one aperture formed in said frame for each key, and said anchored end of each said spring means is received within the corresponding aperture.

6. A keyboard mechanism as in claim 5 wherein each said spring means comprises two of said flexure spring arms disposed on opposite sides of said key, and said trapping segment is a bight connecting said two arms to form a U-shaped spring member straddling said key.

7. A keyboard mechanism as in claim 6 wherein said anchored end of each said spring means is bent at a wrist location for ease of insertion into said aperture.

8. A keyboard mechanism comprising: a frame; a key oriented with its longitudinal axis extending forwardly and rearwardly; fulcrum means on said frame supporting said key at a pivot location for pivotal motion about a transverse axis; return spring means including two flexure spring arms each bent to form an elbow, the outer ends of said arms being joined by a bight; anchoring means on said frame engaging an inner end of said spring arms at an anchoring location; trapping means on said key engaging said bight at a biasing location between said pivot location and one end of said key; the distance between said biasing location and said anchoring location being so selected that when said key is pivoted in one direction about said fulcrum means said spring arms are flexurally stressed to force said elbows to assume an angle different from that which they assume in their rest condition whereby said spring arms exert a biasing force on said key to pivot it back toward its initial position.

9. A keyboard mechanism as in claim 8 wherein said bight engages the outer surface of said key; said arms extend inwardly on opposite sides of said key; and said trapping means includes at least one trapping notch extending transversely across said outer surface of said key; said bight being trapped in said notch.

10. A keyboard mechanism as in claim 9 further comprising a plurality of alternative spring-trapping notches each extending transversely across the outer surface of said key at respective different locations to force said elbows of said arms to open to different angles beyond their rest position when said key is pivoted, whereby to afford a choice of respective different return forces on said key depending on which of said notches is chosen to trap said bight.

11. A keyboard mechanism as in claim 8 wherein: said fulcrum means comprises an upstanding member supporting said key for said pivotal motion; said anchoring means comprises aperture means formed in said upstanding member; and said inner end of said spring arms are received within said aperture means.

12. A keyboard mechanism as in claim 11 wherein said spring arms are bent at a wrist location so that said inner ends thereof are at least approximately parallel to the outer end of said arm for ease of insertion unto said aperture means.

13. A keyboard mechanism as in claim 8 wherein said anchoring location is on the inward side of said pivot location and said biasing location is on the outward side of said pivot location and said return spring means is pre-loaded whereby a force is exerted by said return spring means to retain said key in assembly with said fulcrum means even when said key is at rest.

14. A keyboard mechanism as in claim 8 wherein said arms extend inwardly on opposite sides of said key, said anchoring means include a pair of apertures positioned below and on either side of said key and in line with said inner ends of said spring arms, and said spring arms straddle said key closely enough to prevent lateral misalignment of said inner spring arms relative to said apertures during installation of said spring.

* * * * *